US010249231B2

(12) United States Patent
Cha et al.

(10) Patent No.: US 10,249,231 B2
(45) Date of Patent: Apr. 2, 2019

(54) DISPLAY DEVICE AND OPTICAL COMPENSATION METHOD OF A DISPLAY DEVICE

(71) Applicant: Samsung Display Co., Ltd., Yongin-si, Gyeonggi-do (KR)

(72) Inventors: Ui-Yeong Cha, Hwaseong-si (KR); Dan-Bi Kim, Hwaseong-si (KR); In-Hwan Kim, Asan-si (KR); Byung-Geun Jun, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 5 days.

(21) Appl. No.: 15/389,997

(22) Filed: Dec. 23, 2016

(65) Prior Publication Data

US 2017/0206825 A1 Jul. 20, 2017

(30) Foreign Application Priority Data

Jan. 19, 2016 (KR) ..... 10-2016-0006311

(51) Int. Cl.
*G09G 3/20* (2006.01)
*G09G 3/3208* (2016.01)

(52) U.S. Cl.
CPC ..... *G09G 3/2092* (2013.01); *G09G 3/3208* (2013.01); *G09G 2310/08* (2013.01); *G09G 2320/029* (2013.01); *G09G 2320/0233* (2013.01); *G09G 2320/0276* (2013.01); *G09G 2320/0646* (2013.01); *G09G 2320/0673* (2013.01); *G09G 2320/0693* (2013.01)

(58) Field of Classification Search
CPC ..... G09G 3/2092
USPC ..... 345/690
See application file for complete search history.

(56) References Cited

U.S. PATENT DOCUMENTS

2012/0206504 A1 8/2012 Ha et al.
2013/0120659 A1 5/2013 Park et al.
2014/0313235 A1 10/2014 Park et al.
2014/0320475 A1* 10/2014 Shin ..... G09G 3/3275 345/212

FOREIGN PATENT DOCUMENTS

KR 10-2014-0086167 7/2014
KR 10-2016-0130005 11/2016

OTHER PUBLICATIONS

EPO Extended Search Report dated May 10, 2017, for corresponding European Patent Application No. 17152291.5 (12 pages).

* cited by examiner

*Primary Examiner* — Long D Pham
(74) *Attorney, Agent, or Firm* — Lewis Roca Rothgerber Christie LLP

(57) ABSTRACT

An optical compensation method for a display device including a pixel is provided. The method includes: providing test data having a first grayscale value to the display device; measuring a luminance of the pixel which emits light based on the test data; and calculating a compensation grayscale value based on a second target luminance and the measured luminance of the pixel. The second target luminance is lower than a first target luminance which is set based on the first grayscale value.

18 Claims, 7 Drawing Sheets

DISPLAY DEVICE AND OPTICAL COMPENSATION METHOD OF A DISPLAY DEVICE

CROSS-REFERENCE TO RELATED APPLICATION

This application claims priority under 35 U.S.C. § 119 to and the benefit of Korean Patent Application No. 10-2016-0006311, filed on Jan. 19, 2016 in the Korean Intellectual Property Office (KIPO), the contents of which are incorporated herein in their entirety by reference.

BACKGROUND

1. Field

Example embodiments relate to a display device.

2. Description of the Related Art

An organic light emitting display device includes pixels, and each of the pixels includes an organic light emitting diode and a thin film transistor which drives the organic light emitting diode. The thin film transistor may be formed through a crystallization process (e.g., a melting process and a solidification process) of a low-temperature poly-silicon (LTPS). However, thin film transistors may have uneven characteristics (e.g., uneven current-voltage characteristics) due to the crystallization process.

An optical compensation method is proposed for compensating a grayscale value such that the pixel emits light having a certain or desired luminance despite uneven or varying characteristics among the thin film transistors. The optical compensation method can compensate a grayscale value when the pixel emits light having a relatively high luminance; however, the optical compensation method cannot or cannot adequately compensate a grayscale value when the pixel emits light having a relatively low luminance because the optical compensation method cannot increase the grayscale value over a maximum grayscale value. Therefore, a stain phenomenon (e.g., a mottled phenomenon, a dappled phenomenon, a variegated phenomenon, a parti-colored phenomenon, a spotted phenomenon) occurs on a display panel when input image data including a high grayscale value (e.g., the maximum grayscale value) is provided to the display device.

SUMMARY

Some example embodiments provide an emission driver that can finely control a light emission time of pixels.

Some example embodiments provide a display device including the emission driver.

According to example embodiments, an optical compensation method for a display device including a pixel includes: providing test data having a first grayscale value to the display device; measuring a luminance of the pixel which emits light based on the test data; and calculating a compensation grayscale value based on a second target luminance and the measured luminance of the pixel. The second target luminance is lower than a first target luminance which is set based on the first grayscale value.

In example embodiments, the first grayscale value may be a maximum grayscale value from among grayscale values which are used in the display device, and the first target luminance may be determined based on a grayscale-luminance characteristic of the pixel and the first grayscale value.

In example embodiments, the second target luminance may be lower than the first target luminance by B nits, where B is a positive integer.

In example embodiments, the compensation grayscale value may be a grayscale value difference between the first grayscale value and a second grayscale value, and the pixel may be configured to emit light having a second target luminance based on the second grayscale value.

In example embodiments, the calculating the compensation grayscale value of the pixel may include: calculating a luminance error between the second target luminance and the measured luminance; and calculating the compensation grayscale value based on the second target luminance, the luminance error, and the first grayscale value.

In example embodiments, the compensation grayscale value may be proportional to the luminance error.

In example embodiments, the optical compensation method may further include storing the compensation grayscale value in a memory device in the display device.

In example embodiments, the optical compensation method may further include performing a second multi-time program (MTP) based on the first grayscale value and the first target luminance.

In example embodiments, the performing the second multi-time program may include: providing the test data to the display device; re-measuring the luminance of the pixel which emits light based on a first compensated grayscale value which is generated by compensating the first grayscale value by the compensation grayscale value; calculating a luminance difference between the re-measured luminance and the first target luminance; and when the luminance difference exceeds a reference value, changing a first gamma voltage corresponding to the first compensated grayscale value.

In example embodiments, the performing the second multi-time program may further include: repeating each of the step of providing the test data to the display device through the step of changing the first gamma voltage; and when the luminance difference is lower than the reference value, storing the first gamma voltage.

According to example embodiments, an optical compensation method for a display device including a pixel includes: performing a first multi-time program (MTP) based on a third target luminance and a first grayscale value; providing test data having the first grayscale value to the display device; measuring a luminance of the pixel based on the test data; and calculating a compensation grayscale value of the pixel based on a first target luminance and the measured luminance of the pixel. The first target luminance is determined based on the first grayscale value, and the third target luminance is higher than the first target luminance.

In example embodiments, the first grayscale value may be a maximum grayscale value from among grayscale values which are used in the display device, and the first target luminance may be determined based on a grayscale-luminance characteristic of the pixel and the first grayscale value.

In example embodiments, the third target luminance may be higher than the first target luminance by C nits, where C is a positive integer.

In example embodiments, the compensation grayscale value may be to compensate the first grayscale value for the pixel to emit light having the first target luminance.

In example embodiments, the calculating the compensation grayscale value of the pixel may include: calculating a luminance error between the first target luminance and the measured luminance; and calculating the compensation grayscale value based on the first target luminance, the luminance error, and the first grayscale value.

In example embodiments, the optical compensation method may further include storing the compensation grayscale value in a memory device in the display device.

According to example embodiments, a display device includes a display panel including a pixel; a memory device configured to store a compensation grayscale value to compensate a first grayscale value of input data such that the pixel emits light having a first target luminance based on the first grayscale value; a timing controller configured to operate in a normal mode and in a compensation mode, the timing controller being further configured to generate a first compensated grayscale value by compensating the first grayscale value based on the compensation grayscale value in the compensation mode; and a data driver configured to generate a data signal based on the first compensated grayscale value.

In example embodiments, when the timing controller is in the compensation mode, the pixel may emit light having the first target luminance based on the first compensated grayscale value.

In example embodiments, the timing controller may be further configured to determine whether or not the first compensated grayscale value is equal to the first grayscale value.

In example embodiments, when the timing controller is in the normal mode, the pixel may emit light having a second target luminance based on the first compensated grayscale value, and the second target luminance may be lower than the first target luminance.

An optical compensation method of a display device according to example embodiments may eliminate or substantially eliminate (e.g., remove or prevent) a stain phenomenon of a display panel by calculating a compensation grayscale value based on a grayscale value (e.g., a maximum grayscale value) and a second target luminance that is lower than a first target luminance based on the grayscale value, and by performing a multi-time program (e.g., a post-MTP) based on the grayscale value and the first target luminance.

In addition, an optical compensation method of a display device according to example embodiments may provide a simplified optical compensation process by performing a multi-time program (e.g., a pre-MTP) based on the grayscale value (e.g., the maximum grayscale value) and a third target luminance that is higher than a first target luminance based on the grayscale value, and by calculating a compensation grayscale value based on the grayscale value and the first target luminance.

Furthermore, a display device according to example embodiments may have improved display quality (e.g., a quality of a displayed image may be improved) by using a compensation grayscale value that is generated by the optical compensation method.

BRIEF DESCRIPTION OF THE DRAWINGS

Illustrative, non-limiting example embodiments will be more clearly understood from the following detailed description taken in conjunction with the accompanying drawings, in which.

DESCRIPTION OF EMBODIMENTS

Figure 1:
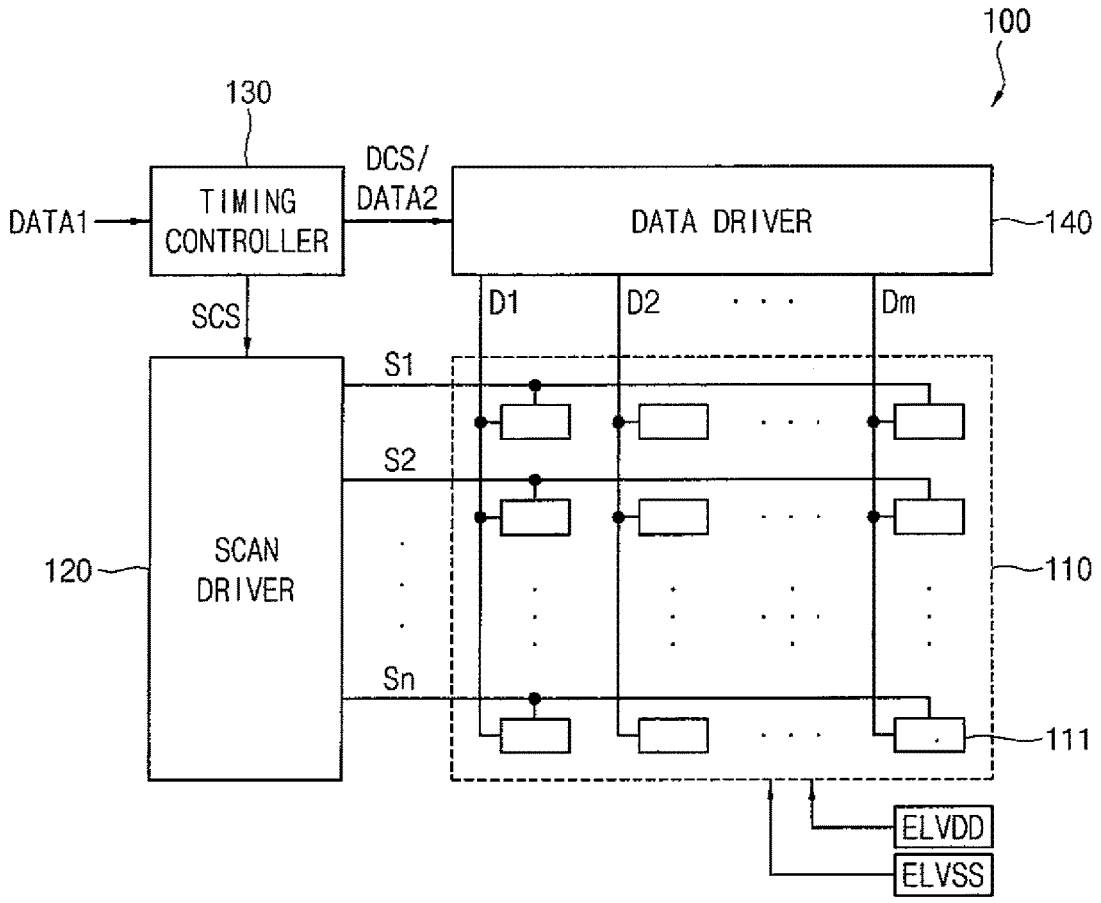
FIG. 1 is a block diagram of a display device according to one or more example embodiments.

Hereinafter, aspects of the present inventive concept will be explained in detail with reference to the accompanying drawings.

It will be understood that when an element or layer is referred to as being "on," "connected to," or "coupled to" another element or layer, it may be directly on, connected, or coupled to the other element or layer or one or more intervening elements or layers may also be present. When an element is referred to as being "directly on," "directly connected to," or "directly coupled to" another element or layer, there are no intervening elements or layers present. For example, when a first element is described as being "coupled" or "connected" to a second element, the first element may be directly coupled or connected to the second element or the first element may be indirectly coupled or connected to the second element via one or more intervening elements. The same reference numerals designate the same elements. As used herein, the term "and/or" includes any and all combinations of one or more of the associated listed items. Further, the use of "may" when describing embodiments of the present invention relates to "one or more embodiments of the present invention." Expressions, such as "at least one of," when preceding a list of elements, modify the entire list of elements and do not modify the individual elements of the list. Also, the term "exemplary" is intended to refer to an example or illustration. As used herein, the terms "use," "using," and "used" may be considered synonymous with the terms "utilize," "utilizing," and "utilized," respectively.

It will be understood that, although the terms first, second, third, etc. may be used herein to describe various elements, components, regions, layers, and/or sections, these elements, components, regions, layers, and/or sections should not be limited by these terms. These terms are used to distinguish one element, component, region, layer, or section from another element, component, region, layer, or section. Thus, a first element, component, region, layer, or section discussed below could be termed a second element, component, region, layer, or section without departing from the teachings of example embodiments. In the figures, dimensions of the various elements, layers, etc. may be exaggerated for clarity of illustration.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" or "over" the other elements or features. Thus, the term "below" may encompass both an orientation of above and below. The device may be otherwise oriented (rotated 90 degrees or at other orientations), and the spatially relative descriptors used herein should be interpreted accordingly.

The terminology used herein is for the purpose of describing particular example embodiments of the present invention and is not intended to be limiting of the described example embodiments of the present invention. As used herein, the singular forms "a" and "an" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components but do not preclude the presence or addition of one or more other features, integers, steps, operations, elements, components, and/or groups thereof.

The scan driver, the timing controller, the data driver and/or any other relevant devices or components according to embodiments of the present invention described herein may be implemented utilizing any suitable hardware, firmware (e.g., an application-specific integrated circuit), software, and/or a suitable combination of software, firmware, and hardware. For example, the various components of the scan driver, the timing controller, and/or the data driver may be formed on one integrated circuit (IC) chip or on separate IC chips. Further, the various components of the scan driver, the timing controller, and/or the data driver may be implemented on a flexible printed circuit film, a tape carrier package (TCP), a printed circuit board (PCB), or formed on a same substrate as the scan driver, the timing controller, and/or the data driver. Further, the various components of the scan driver, the timing controller, and/or the data driver may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device or the functionality of a particular computing device may be distributed across one or more other computing devices without departing from the scope of the exemplary embodiments of the present invention.

FIG. 1 is a block diagram of a display device according to one or more example embodiments.

Referring to FIG. 1, a display device 100 may include a display panel 110, a scan driver 120, a timing controller 130, and a data driver 140.

The display device 100 may display an image based on image data provided from an external component. For example, the display device 100 may be an organic light emitting display device.

The display panel 110 may include scan lines S1 through Sn, data lines D1 through Dm, and pixels 111, where each of m and n is an integer greater than or equal to two. The pixels 111 may be disposed at cross-regions of the scan lines S1 through Sn and the data lines D1 through Dm, respectively. Each of the pixels 111 may store data (e.g., a data signal) in response to a scan signal and may emit light based on the stored data.

The scan driver 120 may generate the scan signal based on a scan driving control signal SCS. The scan driving control signal SCS may be provided from the timing controller 130 to the scan driver 120. The scan driving control signal SCS may include a start pulse and clock signals, and the scan driver 120 may include a shift register for sequentially generating the scan signal corresponding to the start pulse and the clock signals.

The timing controller 130 may control the scan driver 120 and the data driver 140. The timing controller 130 may generate the scan driving control signal SCS and a data driving control signal DCS and may control the scan driver 120 and the data driver 140 based on these generated signals.

In some example embodiments, the timing controller 130 may include a first mode (e.g., a normal mode) and a second mode (e.g., a compensation mode). In the first mode, the timing controller 130 may generate second data DATA2 (e.g., a second data signal) based on first data DATA1 (e.g., a first data signal). For example, the timing controller 130 may generate the second data DATA2, which is substantially the same as the first data DATA1. In the second mode, the timing controller 130 may generate the second data DATA2 by compensating (e.g., adjusting) the first data DATA1 based on a compensation grayscale value. In one embodiment, the compensation grayscale value is a grayscale value for compensating a certain grayscale value such that the pixels 111 each emit light having a certain target luminance based on the certain grayscale value. For example, the compensation grayscale value is a grayscale value for compensating a first grayscale value (e.g., a maximum grayscale value) such that the pixels 111 each emit light having a first target luminance (e.g., a maximum luminance) based on the first grayscale value. In this embodiment, the timing controller 130 may generate a first compensated grayscale value by compensating the first grayscale value based on the compensation value, and the pixels 111 may emit light having the first target luminance based on the first compensated grayscale value.

In an example embodiment, the timing controller 130 may determine or set the compensated grayscale value to be equal to the first grayscale value in the first mode (e.g., when the first mode is selected). For example, the timing controller 130 may generate the second data DATA2 that is substantially the same as the first data DATA1 in the first mode. In the first mode, the pixels 111 may emit light having another luminance (e.g., a second target luminance which is lower than the first target luminance) that is different from the first target luminance based on the first grayscale value included in the first data DATA1.

In an example embodiment, the timing controller 130 may include a memory device for storing the compensation grayscale value. For example, the memory device may include (e.g., may store) the first compensation grayscale value for compensating the first grayscale value. In this embodiment, the first grayscale value may be a maximum grayscale value (e.g., a grayscale value of 255 from among grayscale values of 0 through 255) used in the display device 100.

In an example embodiment, the timing controller 130 may generate a second compensated grayscale value for a certain grayscale value by interpolating the first compensation grayscale value. For example, the timing controller 130 may calculate the second compensated grayscale value of minus 5 (−5) for compensating a grayscale value of 127 by interpolating a reference compensation grayscale value of 0 and the first compensation grayscale value of minus 10 (−10), where the reference compensation grayscale value of 0 is to compensate a grayscale value of 0, and the first compensation grayscale value of minus 10 (−10) is to compensate a grayscale value of 127.

The data driver 140 may generate the data signal based on the second data DATA2, and the data driver 140 may provide the data signal to the display panel 110 (e.g., to the pixels 111) in response to the data driving control signal DCS.

In some example embodiments, the data driver 140 may include a gamma correction value. In one embodiment, the gamma correction value may be a voltage for compensating a gamma voltage (e.g., the data signal) provided to a certain pixel such that the certain pixel may emit light having a certain luminance based on a certain grayscale value. The gamma correction value may be set by a multi-time program ("MTP") (e.g., set through a multi-time program). For example, the gamma correction value may be set with respect to a pixel which is (or pixels which are) located at a center of the display panel 110 during a manufacturing process of the display panel 110 such that a gamma characteristic curve of the pixel or pixels may be the same as or substantially the same as a gamma characteristic curve of a reference pixel. In this embodiment, the data driver 140 may generate a compensated gamma voltage based on the gamma correction value and the gamma characteristic curve of the reference pixel.

The display device 100 may further include a power supply (e.g., a power supplier). The power supply may generate a driving voltage to drive the display device 100. The driving voltage may include a first power voltage ELVDD and a second power voltage ELVSS. The first power voltage ELVDD may be greater than (higher than) the second power voltage ELVSS.

As described above, the display device 100 according to example embodiments may include (e.g., store) a compensation grayscale value for the first grayscale value (e.g., a maximum grayscale value), may compensate the first data DATA1 based on the compensation grayscale value, and may display an image based on the compensated first data DATA1 (e.g., the second data DATA2). Therefore, the display device 100 may eliminate or reduce the occurrence or severity of a luminance stain phenomenon which occurs at a certain grayscale region (e.g., at a relatively high grayscale region) and, thus, may improve a display quality.

A multi-time program may be a process for a pixel 111 (e.g., a first pixel) at a center of the display panel 110 to have a gamma characteristic curve that is the same as or substantially the same as a gamma characteristic curve of the reference pixel. The optical compensation may be a process to equalize (e.g., to make uniform or substantially uniform) a total or overall luminance of the display panel 110 with respect to the first pixel (e.g., with respect to a luminance of the first pixel). For example, the optical compensation may be a process to compensate a grayscale value that is provided to pixels except for the first pixel such that gamma characteristics of the remaining pixels are the same as or substantially the same as a gamma characteristic of the first pixel.

Therefore, all of the pixels 111 included in the display panel 110 may have a gamma characteristic (e.g., a light emitting characteristic) which is the same as or substantially the same as a reference gamma characteristic of the reference pixel. That is, the pixels 111 may emit light having the same or substantially the same luminance based on a certain grayscale value (e.g., the same grayscale value).

Figure 2A:
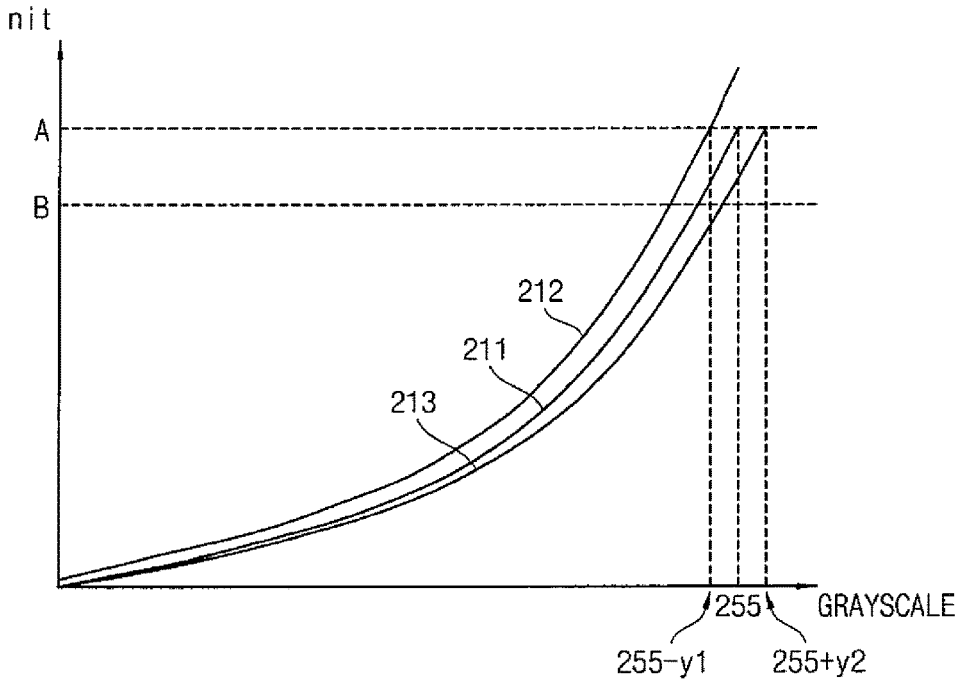
FIG. 2A is a graph of an example gamma characteristic of a pixel included in the display device shown in FIG. 1.
Figure 2B:
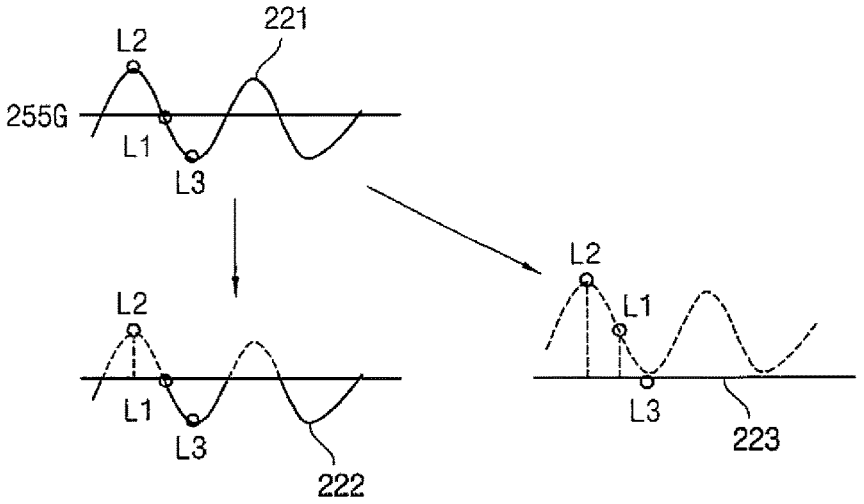
FIG. 2B is a graph of an example luminance of a pixel included in the display device shown in FIG. 1.
Figure 2C:
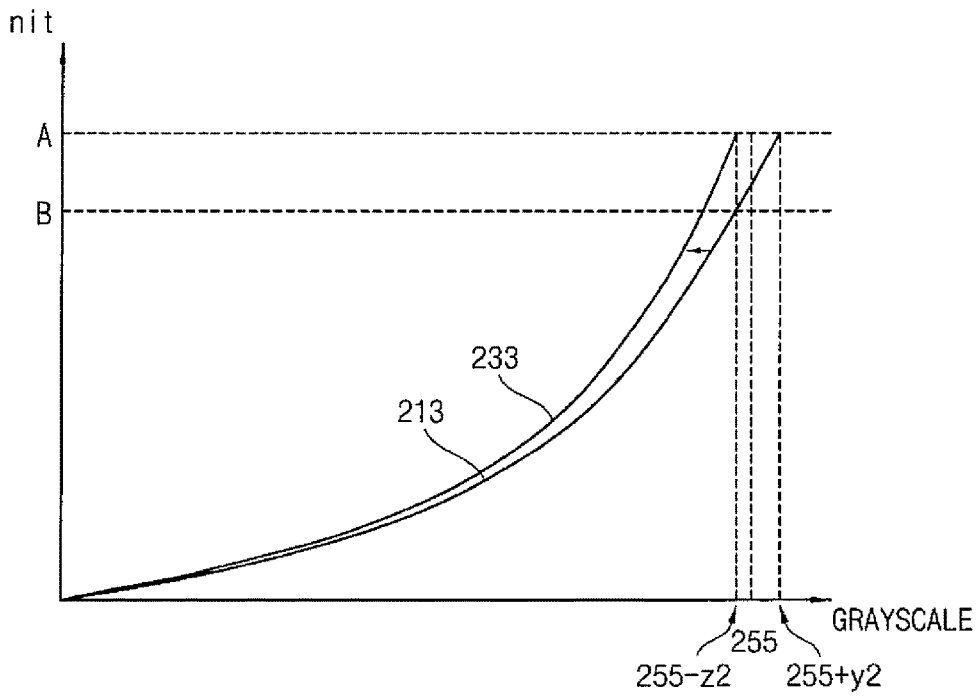
FIG. 2C is a graph of an example gamma characteristic of a pixel included in the display device shown in FIG. 1.

FIG. 2A is a graph showing an example gamma characteristic of a pixel included in the display device shown in FIG. 1. FIG. 2B is a graph of an example luminance of a pixel included in the display device shown in FIG. 1. FIG. 2C is a graph of an example gamma characteristic of a pixel included in the display device shown in FIG. 1.

Referring to FIGS. 1 and 2A, gamma characteristics of a pixel may be different or may vary according to a location of the pixel in the display panel 110.

A first curve 211 may represent a gamma characteristic of a first pixel which is at a center of the display panel 110, a second curve 212 may represent a gamma characteristic of a second pixel which is in a first area (e.g., an area adjacent to the scan driver 120 illustrated in FIG. 1) of the display panel 110, and a third curve 213 may represent a gamma characteristic of a third pixel which is in a second area (e.g., an area adjacent to the data driver 140 illustrated in FIG. 1) of the display panel 110. The gamma characteristics may represent a correlation between a grayscale value and a luminance. For example, the first curve 211 may be a gamma curve 2.2.

According to the first curve 211, the first pixel may emit light having A nits based on a grayscale value of 255, where A is a positive integer. For example, A nits may be 300 nits, which is a maximum luminance (e.g., a maximum target luminance) of the display device 100.

According to the second curve 212, the second pixel may emit light having A+x1 (A plus x1) nits based on a grayscale value of 255, where x1 is a positive integer. The second pixel may emit light having A nits based on a grayscale value of 255−y1 (255 minus y1). Therefore, the display device 100 may compensate a grayscale value of 225 provided to the second pixel by reducing the provided grayscale value of 255 by y1 (e.g., a grayscale error of y1) such that the second pixel may emit light having A nits, which is a target luminance, based on a compensated grayscale value of 255 (e.g., a grayscale value of 255−y1). In this embodiment, a compensation grayscale value to compensate a grayscale value of 255 (e.g., a first grayscale value) for the second pixel may be y1, and the compensation grayscale value may be stored in the memory device.

According to the third curve 213, the third pixel may emit light having A−x2 (A minus x2) nits based on a grayscale value of 255, where x2 is a positive integer. The third pixel may emit light having A nits based on a grayscale value of 255+y2 (255 plus y2). However, the third pixel may be not able to emit light having A nits through the optical compensation (e.g., an optical compensation process) because a maximum grayscale value used in the display device 100 may be a grayscale value of 255 (e.g., a grayscale value of 255 from among grayscale values of 0 through 255).

Referring to FIG. 2B, the first measured luminance curve 221 may represent luminance of pixels which emit light based on a maximum grayscale value (e.g., a grayscale value of 255) and the first measured luminance curve 221 may include first through third luminances which are measured at the first through third pixels, respectively. According to the first measured luminance curve 221, a first luminance L1 may be a first measured luminance for the first pixel, a second luminance L2 may be a second measured luminance for the second pixel, and a third luminance L3 may be a third measured luminance for the third pixel.

As illustrated in FIG. 2B, prior to the optical compensation (e.g., the optical compensation process), the first luminance L1 may be the same as or substantially the same as a first target luminance, the second luminance L2 may be higher (greater) than the first target luminance, and the third luminance L3 may be lower (less) than the first target luminance according to the first measured luminance curve 221. In a typical display device performing a typical or existing optical compensation, the first luminance L1 and the second luminance L2 may be the same as or substantially the same as the first target luminance, but the third luminance L3 may be lower than the first target luminance because the typical display device may not be able to compensate a grayscale value for the third pixel to have a value greater than a maximum grayscale value.

The display device 100 according to an example embodiment may include a compensation grayscale value which is set based on a maximum grayscale value and a second target luminance (e.g., B nits), where the second target luminance is different from the first target luminance (e.g., A nits) that corresponds to the maximum grayscale value. In this embodiment, the second target luminance may be lower than the first target luminance. For example, the second target luminance may be set to have enough margin (e.g., a luminance difference between the first target luminance and the second target luminance) by considering a luminance distribution of the pixels 111 (e.g., an unevenness of luminance of the pixels 111 due to uneven characteristics of the pixels 111). Then, the display device 100 may reset (e.g., re-determine) a gamma voltage using a multi-time program (e.g., a second multi-time program). Therefore, the pixels 111 included in the display device 100 may emit light having A nits based on a compensated maximum grayscale value (e.g., a sum of the compensation grayscale value and a maximum grayscale value). The multi-time program will be described in further detail with reference to FIGS. 5 and 6.

Referring to FIG. 2C, the third pixel may emit light having B nits based on a grayscale value of 255−z2 (255 minus z2) according to the third curve 213. In this embodiment, a compensation grayscale value to compensate a grayscale value of 255 (e.g., a first grayscale value) for the third pixel may be z2.

In this embodiment, the display device 100 may reset a gamma voltage for the pixels 111 to emit light according to a fourth curve 233 (e.g., a third measured luminance curve). The fourth curve 223 may represent a compensated gamma characteristic of the pixels 111.

Referring again to FIG. 2B, in the display device 100 according to an example embodiment, the pixels 111 may emit light having the first luminance L1 through the third luminance L3 based on a grayscale value of 255 according to the third measured luminance curve 223, and each of the first luminance L1 through the third luminance L3 may be the same as or substantially the same as the first target luminance.

As described above, the pixels 111 (e.g., the first through third pixels) included in the display device 100 according to an example embodiment may emit light having the first target luminance (e.g., A nits) based on the maximum grayscale value (e.g., a grayscale value of 255). Therefore, the display device 100 may display an image without a luminance stain phenomenon in a high grayscale region (e.g., when a maximum grayscale value is provided to the display device 100).

Figure 3:
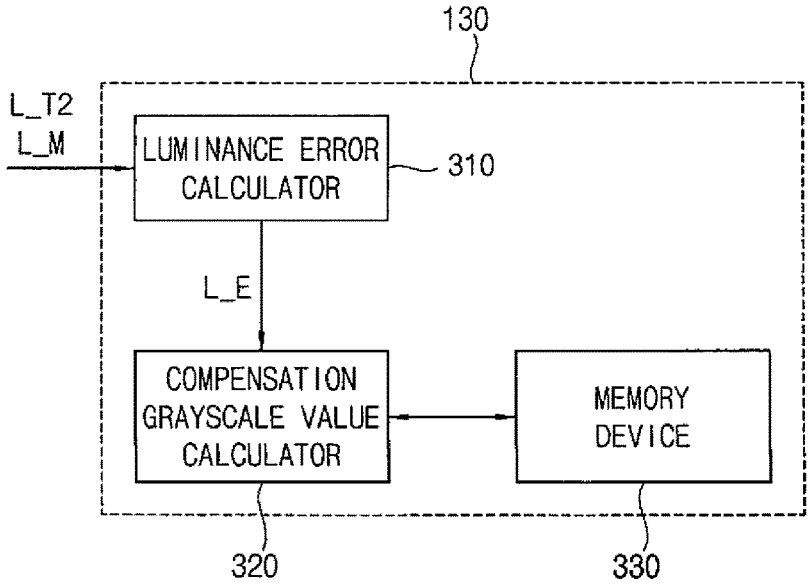
FIG. 3 is a block diagram of a timing controller included in the display device shown in FIG. 1.

FIG. 3 is a block diagram of a timing controller included in the display device shown in FIG. 1.

Referring to FIG. 3, the timing controller 130 may include a luminance error calculating block 310 (e.g., a luminance error calculator), a compensation grayscale value calculating block 320 (e.g., a compensation grayscale value calculator), and a memory device 330.

The luminance error calculating block 310 may calculate a luminance error between a second target luminance L_T2 and a measured luminance L_M. In one embodiment, the measured luminance L_M may be a measured luminance for a pixel when the pixel emits light based on a first grayscale value, and the second target luminance L_T2 may be lower (less) than a first target luminance which is set based on the first grayscale value. For example, with reference to FIG. 2A, the measured luminance L_M may be a measured luminance for the pixel which emits light based on a maximum grayscale value of 255, and the second target luminance L_T2 may be B nits, which is lower than A nits set based on the maximum grayscale value of 255.

The measured luminance L_M may be measured by an external device (e.g., by a luminance measuring device) and provided to the timing controller 130. For example, the timing controller 130 may receive the measured luminance L_M from a charge-coupled device camera (a CCD camera).

The compensation grayscale value calculating block 320 may calculate a compensation grayscale value based on the second target luminance L_T2, a luminance error L_E, and a first grayscale value. In an example embodiment, the compensation grayscale value calculating block 320 may calculate the compensation grayscale value using the Equation 1 below:

$$Gcomp = L_T2/Gmax * Lerr$$

Where, Gcomp denotes the compensation grayscale value, L_T2 denotes the second target luminance, Gmax denotes the first grayscale value, and Lerr denotes the luminance error.

For example, when the second target luminance L_T2 is 280 nits, the first grayscale value is 255, and the luminance error Lerr is 4.55, the compensation grayscale value Gcomp may be 5 (280/255*4.55=5).

For example, the compensation grayscale value calculating block 320 may calculate the compensation grayscale value using the Equation 1 under an assumption that a gamma characteristic curve is linear in a certain region (e.g., a region in a range of grayscale values of 200 through 255). In this case, the compensation grayscale value may be proportional to the luminance error.

The memory device 330 may store and update the compensation grayscale value. An initial value of the compensation grayscale value may be 0. For example, the memory device 330 may a non-volatile memory (NVM), such as an electrically erasable programmable read-only memory (EEPROM).

The timing controller 130 may generate the second data DATA2 by compensating the first data DATA1 based on the compensation grayscale value stored in the memory device 330.

As described above, the timing controller 130 may calculate and store the compensation grayscale value based on the second target luminance and the measured luminance and may generate the second data DATA2 by compensating the first data DATA1 based on the compensation grayscale value.

It is illustrated in FIG. 3 that the luminance error calculating block 310 and the compensation grayscale value calculating block 320 are included in the timing controller 130. However, the luminance error calculating block 310 and the compensation grayscale value calculating block 320 are not limited thereto. For example. the luminance error calculating block 310 and the compensation grayscale value calculating block 320 may be provided in outside of the timing controller 130 and/or may be implemented independently on the display device 100.

Figure 4:
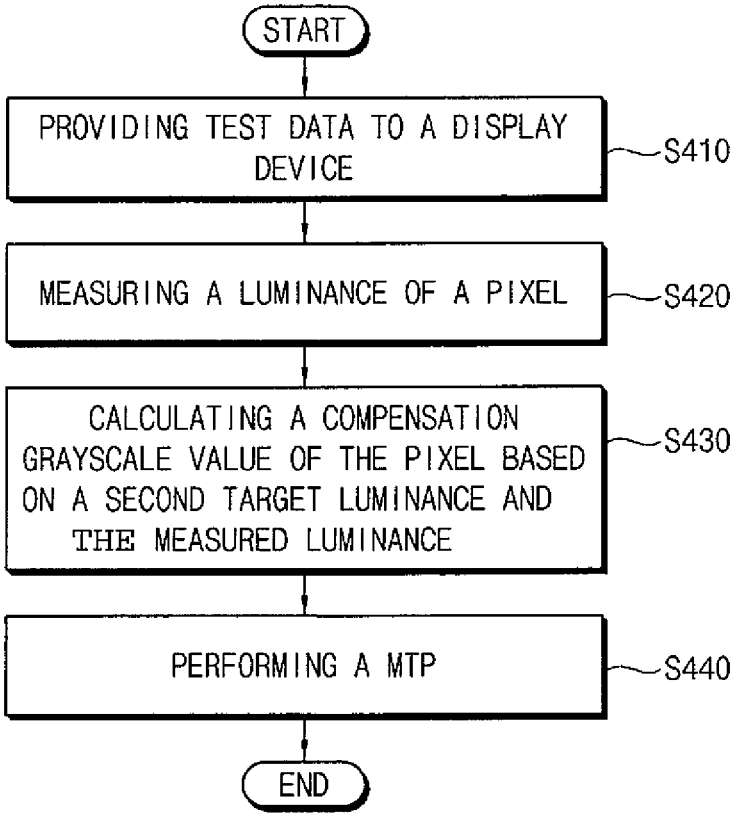
FIG. 4 is a flow diagram of an optical compensation method of a display device according to one or more example embodiments.

FIG. 4 is a flow diagram of an optical compensation method of a display device according to one or more example embodiments.

Referring to FIGS. 1 and 4, the method illustrated in FIG. 4 may be performed for or by the display device shown in FIG. 1.

The method illustrated in FIG. 4 may provide test data to the display device 100 (S410). In one embodiment, the test data may include (or have) a first grayscale value, and the first grayscale value may be a maximum grayscale value (a highest grayscale value) from among grayscale values used in the display device 100. For example, the test data may include (e.g., may only include or may be) a grayscale value of 255.

The method illustrated in FIG. 4 may measure a luminance of a pixel which emits light based on the test data (S420). For example, the method illustrated in FIG. 4 may measure the luminance of each of the pixels 111 included in the display device 100 using a luminance measuring device, which is implemented independently on the display device 100.

The method illustrated in FIG. 4 may calculate a compensation grayscale value of the pixel based on a second target luminance and the measured luminance (S430). In one embodiment, the second target luminance may be lower (less) than a first target luminance, and the first target luminance may be set (or determined) based on a first grayscale value and a correlation between a grayscale value and the luminance of the pixel (e.g., a gamma characteristic of the pixel). For example, with reference to FIG. 2A, the second target luminance may be B nits, the first target luminance may be A nits, and the first grayscale value may be 255.

In an example embodiment, the method illustrated in FIG. 4 may calculate a luminance error between the second target luminance and the measured luminance and may calculate the compensation grayscale value based on the luminance error and the first grayscale value. As described above with reference to FIG. 3, the method illustrated in FIG. 4 may calculate the compensation grayscale value using the Equation 1.

The method illustrated in FIG. 4 may store the compensation grayscale value in a memory device included in the display device 100.

In this embodiment, the pixels 111 included in the display device 100 may emit light having the second target luminance based on the first grayscale value. For example, when data including the first grayscale value is provided to the display device 100, the display device 100 may compensate the first grayscale value based on the compensation grayscale value, and the pixels 111 may emit light based on the first grayscale value (e.g., a first compensated grayscale value) that is compensated. Therefore, the pixels may emit light having the second target luminance.

Accordingly, a luminance stain phenomenon of the display panel 110 may be reduced or eliminated. However, the pixels 111 may emit light having the second target luminance instead of the first target luminance.

In some example embodiments, the method illustrated in FIG. 4 may perform a second multi-time program (e.g., a post-multi-time program) for the display device 100 based on the first grayscale value and the first target luminance (S440). In one embodiment, the second multi-time program may be a multi-time program that is performed after an optical compensation (e.g., after compensating a grayscale value). For example, the method illustrated in FIG. 4 may adjust (or change) a gamma voltage which is set based on the first grayscale value, such that the pixels 111 may emit light having the first target luminance based on the first grayscale value. In one embodiment, the pixels 111 may emit light having the first target luminance based on an adjusted gamma voltage.

In an example embodiment, the method illustrated in FIG. 4 may provide the test data to the display device 100, may re-measure the luminance of the pixels 111 that emit light based on the first compensated grayscale value (e.g., a first grayscale value which is compensated based on the compensation grayscale value), may calculate a luminance difference between the re-measured luminance and the first target luminance, and may determine whether or not the luminance difference exceeds a reference value.

When the luminance difference exceeds the reference value, the method illustrated in FIG. 4 may adjust (or change) a first gamma voltage corresponding to the first compensated grayscale value. For example, the method illustrated in FIG. 4 may repeatedly perform a step of providing (e.g., may repeatedly provide) the test data to the display device 100 through or during a step of changing the first gamma voltage until the luminance difference is lower (less) than the reference value. Then, the method illustrated in FIG. 4 may store the first gamma voltage which is adjusted when the luminance difference is lower than the reference value. In this embodiment, the data driver 140 may generate a data voltage based on the first gamma voltage. The second multi-time program will be described in more detail with reference to FIGS. 5 and 6.

As described above, the method illustrated in FIG. 4 may perform an optical compensation based on the first grayscale value and the second target luminance (e.g., the second target luminance that is lower than the first target luminance corresponding to the first grayscale value). Therefore, the method illustrated in FIG. 4 may compensate (or eliminate) a luminance stain phenomenon at a certain grayscale value (e.g., in a high grayscale region). In addition, the method illustrated in FIG. 4 may compensate the gamma voltage using (or through) the second multi-time program. Therefore, the pixels 111 may emit (e.g., may correctly emit) light having the first target luminance based on the first grayscale value (e.g., may emit light without a luminance error).

Figure 5:
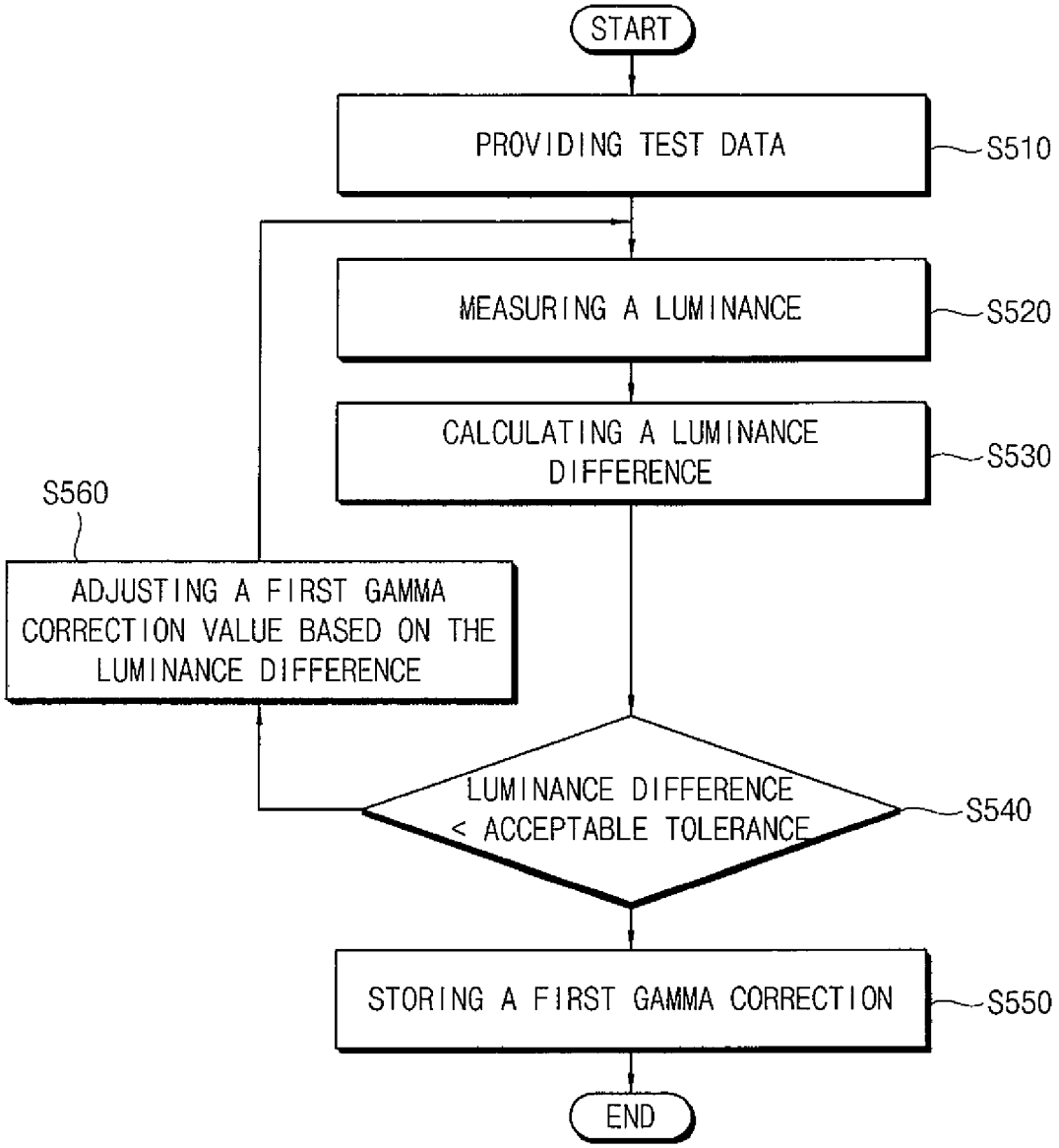
FIG. 5 is a flow diagram of a second multi-time program included in the optical compensation method illustrated in FIG. 4.
Figure 6:
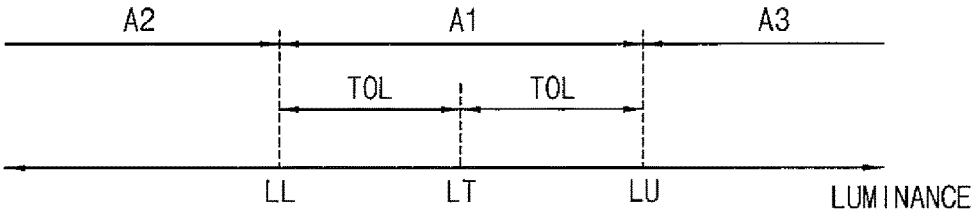
FIG. 6 is a diagram illustrating the second multi-time program included in the optical compensation method illustrated in FIG. 4.

FIG. 5 is a flow diagram of a second multi-time program included in the optical compensation method illustrated in FIG. 4. FIG. 6 is a diagram of a second multi-time program included in the optical compensation method illustrated in FIG. 4.

Referring to FIGS. 5 and 6, the method illustrated in FIG. 5 may provide test data to the display device 100 (S510). In one embodiment, the test data may be the same as or substantially the same as the test data described above with reference to FIG. 4. In this embodiment, the data driver 140 may generate a data voltage based on the test data (e.g., a first grayscale value) and a gamma correction value, and the pixels 111 may emit light based on the data voltage. The gamma correction value may be set to compensate for a luminance error between a target luminance of the pixels 111 and a real luminance (e.g., a measured luminance) of the pixels 111. An initial value of the gamma correction value may be 0. For example, the pixels 111 may emit light according to the third curve 213 described with reference to FIG. 2C.

The method illustrated in FIG. 5 may measure a luminance of the pixels 111 (S520). For example, the method illustrated in FIG. 5 may measure the luminance of a pixel which is at a center of the display panel 110 using a luminance measuring device.

The method illustrated in FIG. 5 may calculate a luminance difference between the target luminance and the real luminance (S530). For example, with reference to FIG. 2C, the target luminance, which is set based on the first grayscale value, may be represented on the third curve 213, and the real luminance (e.g., the measured luminance) may be represented on the fourth curve 233.

The method illustrated in FIG. 5 may determine whether or not the luminance difference is lower than a reference value (e.g., whether the luminance difference is within acceptable tolerances). In one embodiment, the acceptable tolerances may represent tolerances of a gamma setting (e.g., a gamma curve) for the display panel 110 (or the display device 100). Referring to FIG. 6, a first luminance region A1 may be (e.g., may represent) the acceptable tolerances. The first luminance region A1 may include a lower limit LL and an upper limit LU. In one embodiment, the upper limit LU may be higher (greater) than the target luminance LT by the acceptable tolerances TOL, and the lower limit LL may be lower (less) than the target luminance LT by the acceptable tolerances TOL. For example, the method illustrated in FIG. 5 may determine whether or not a measured luminance is within the first luminance region A1.

In an example embodiment, the method illustrated in FIG. 5 may store a first gamma correction value when the luminance difference is within the acceptable tolerances (S550). For example, when the measured luminance is within the first luminance region A1, the method illustrated in FIG. 5 may determine that the display panel 110 may be operated normally according to a gamma curve (e.g., a predetermined gamma curve) and may store the first gamma correction value in the memory device.

In an example embodiment, when the luminance difference exceeds the acceptable tolerances, the method illustrated in FIG. 5 may compensate the first gamma correction value based on the luminance difference (S560). For example, when the measured luminance is in a second luminance region A2 instead of (e.g., outside of) the first luminance region A1, the method illustrated in FIG. 5 may increase the first gamma correction value by a certain value to increase the measured luminance (e.g., a real luminance). For example, when the measured luminance is in a third luminance region A3 instead of (e.g., outside of or above) the first luminance region A1, the method illustrated in FIG. 5 may decrease the first gamma correction value by a certain value to decrease the measured luminance.

The method illustrated in FIG. 5 may repeatedly perform a step (S520) for measuring the luminance through a step (S540) for determining whether or not the luminance difference is within the acceptable tolerances. For example, the method illustrated in FIG. 5 may re-measure the luminance, may re-calculate the luminance difference between the target luminance and the re-measured luminance, and may determine whether or not the re-calculated luminance difference is within the acceptable tolerances.

The method illustrated in FIG. 5 may store the first gamma correction value, which is compensated, in the memory device when the re-calculated luminance difference is within the acceptable tolerances.

The method illustrated in FIG. 5 may be performed for each grayscale value. For example, the method illustrated in FIG. 5 may be repeatedly performed for each of 256 grayscale values. For example, the method illustrated in FIG. 5 may be repeatedly performed for each of 8 representative grayscale values which are selected from among the 256 grayscale values.

As described above, the method illustrated in FIG. 5 may repeatedly perform a step of compensating a first gamma correction value and a step of measuring a luminance based on the first gamma correction value until the luminance of the pixels 111 (e.g., a luminance of the display panel 110) according to the test data is within the acceptable tolerances and may store the first gamma correction value when the measured luminance is within the acceptable tolerances.

Figure 7:
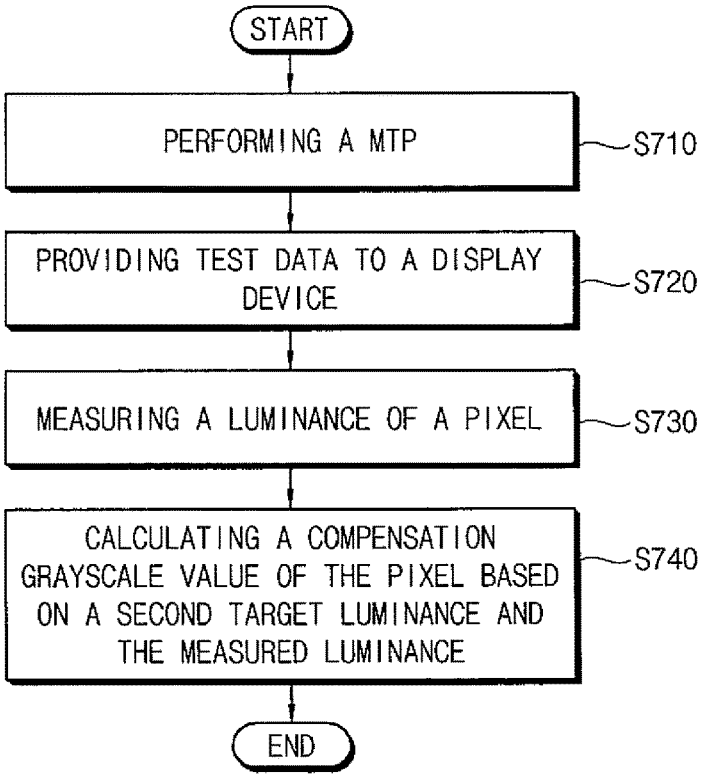
FIG. 7 is a flow diagram of an optical compensation method of a display device according to one or more example embodiments.
Figure 8A:
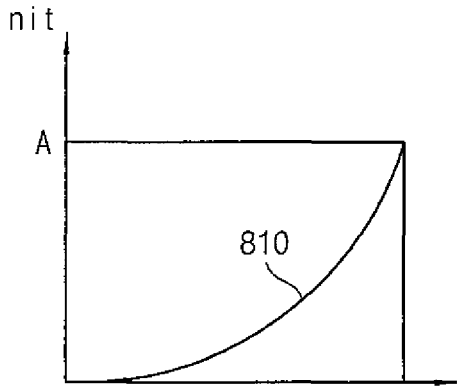
FIG. 8A is a graph of an exemplary first multi-time program included in the optical compensation method illustrated in FIG. 7.
Figure 8B:
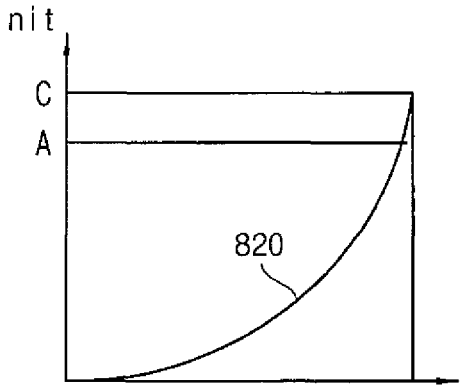
FIG. 8B is a graph of an incorrectly set gamma characteristic curve to be used in the method illustrated in FIG. 7.

FIG. 7 is a flow diagram of an optical compensation method of a display device according to one or more example embodiments. FIG. 8*a* is a diagram of an example of a first multi-time program included in the optical compensation method illustrated in FIG. 7. FIG. 8*b* is a graph of an incorrectly set gamma characteristic curve to be used in the method illustrated in FIG. 7.

Referring to FIGS. 1 and 7-9, the method illustrated in FIG. 7 may be performed for the display device shown in FIG. 1.

The method illustrated in FIG. 7 may perform a first multi-time program for the display device 100 based on a first grayscale value and a third target luminance. In one embodiment, the third target luminance may be higher than a first target luminance determined (set) based on the first grayscale value. For example, with reference to FIG. 1, the first target luminance may be A nits, and the third target luminance may be C nits. The third target luminance may be set (may be determined) to have enough margin (e.g., a luminance difference between the first target luminance and the third target luminance) for a luminance variation of the pixels 111. The first multi-time program may be the same as or substantially the same as the first multi-time program described above with reference to FIGS. 4 through 6; therefore, duplicated description thereof may not be repeated. The second multi-time program described above with reference to FIGS. 4 through 6 may be performed after an optical compensation (e.g., a grayscale compensation), and the first multi-time program may be performed before the optical compensation. The second multi-time program may set (determine) a gamma voltage for the pixels 111 to emit light having a second target luminance in response to the first grayscale value, and the first multi-time program may set (compensate) the gamma voltage for the pixels 111 to emit light having the third target luminance in response to the first grayscale value. Referring to FIG. 8*a*, a sixth curve 810 may represent a reference gamma characteristic curve (e.g., a preset or predetermined gamma characteristic curve) and may be a gamma curve 2.2. For example, a luminance set based on a maximum grayscale value (e.g., a grayscale value of 255) may be A nits according to the sixth curve 810. A typical or existing optical compensation method may perform a multi-time program based on the sixth curve 810. Therefore, pixels included in a display device that are optically compensated through, for example, a multi-time program, by the typical or existing optical compensation method may emit light having A nits based on the maximum grayscale value. However, the pixels may have an uneven luminance due to a variation of gamma characteristics among the pixels.

Referring to FIG. 8*b*, a seventh curve 820 may represent a gamma characteristic curve which is incorrectly set (e.g., is aimed wrong) to be used in the method illustrated in FIG. 7. For example, a luminance set based on the maximum grayscale value (e.g., a grayscale value of 255) may be C nits, which is higher (greater) than A nits. The method illustrated in FIG. 7 may perform the first multi-time program based on the seventh curve 820. Therefore, the pixels 111 included in the display device 100 may emit light having C nits in response to the maximum grayscale value.

The method illustrated in FIG. 7 may perform a grayscale compensation (e.g., an optical compensation). For example, the method illustrated in FIG. 7 may provide test data to the display device 100 (S720), may measure a luminance of a pixel (or of the pixels 111), which emits light based on the test data (S730), and may calculate a compensation grayscale value of the pixel (or of the pixels 111) based on the first target luminance and the measured luminance (S740).

A step S720 for providing the test data to the display device 100 through a step S740 for calculating the compensation grayscale value of the pixel may be the same as or substantially the same as the step S410 for providing the test data to the display device 100 through the step S430 for calculating the compensation grayscale value of the pixel. The step S410 through the step S430 are described above with reference to FIG. 4; therefore, duplicated description thereof may not be repeated.

For reference, the method illustrated in FIG. 4 may calculate a compensation grayscale value of the pixels 111 based on the second target luminance and the measured luminance, and the method illustrated in FIG. 7 may calculate a compensation grayscale value of the pixels 111 based on the first target luminance and the measured luminance (e.g., the method illustrated in FIG. 7 may perform a normal optical compensation).

The pixels 111, which are compensated through the first multi-time program, may emit light having the third target luminance (e.g., C nits) instead of the first target luminance (e.g., A nits) based on the maximum grayscale value (e.g., a grayscale value of 255) according to the third measured luminance curve 223 described with reference to FIG. 2B, and a minimum luminance of the pixels 111 may be higher (greater) than the first target luminance (e.g., A nits) despite of a variation of gamma characteristics of the pixels 111. Therefore, a compensation grayscale value for the pixels 111 to emit light having the first target luminance based on the maximum grayscale value may be smaller (lower) than 0 (e.g., a grayscale value of 0).

Therefore, the pixels 111 may emit light having the same or substantially the same luminance and may emit light having the first target luminance based on the first grayscale value due to the optical compensation (e.g., the grayscale compensation). While the method illustrated in FIG. 4 may use the second multi-time program (e.g., post-multi-time program), the method illustrated in FIG. 7, in one or more embodiments, may not use the second multi-time program.

As described above, the optical compensation method of the display device according to example embodiments may perform a multi-time program based on the first grayscale value (e.g., a maximum grayscale value) and the third target luminance, which is higher (greater) than the first target luminance (e.g., the maximum grayscale value) set based on the first grayscale value, and may calculate the compensation grayscale value based on the first grayscale value and the first target luminance. Therefore, the optical compensation method according to example embodiments may provide a simplified optical compensation process.

The present inventive concept may be applied to any display device (e.g., an organic light emitting display device, a liquid crystal display device, etc.) including an emission driver. For example, the present inventive concept may be applied to a television, a computer monitor, a laptop, a digital camera, a cellular phone, a smart phone, a personal digital assistant (PDA), a portable multimedia player (PMP), an MP3 player, a navigation system, a video phone, etc.

The foregoing is illustrative of example embodiments and is not to be construed as limiting thereof. Although a few example embodiments of the present inventive concept have been described herein, those skilled in the art will readily appreciate that many modifications are possible in the example embodiments without materially departing from the aspects and features of the present inventive concept. Accordingly, all such modifications are intended to be included within the scope of example embodiments as defined in the claims. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed and that modifications to the disclosed example embodiments, as well as other example embodiments, are intended to be included within the scope of the description herein and the appended claims. The inventive concept is defined by the following claims and their equivalents.

What is claimed is:

1. An optical compensation method for a display device comprising a plurality of pixels, the method comprising:

providing test data having a first grayscale value to the display device;

measuring a luminance of the pixels which emit light based on the test data;

calculating a unique compensation grayscale value for each of the pixels based on a second target luminance and the measured luminance of each of the pixels, the second target luminance being lower than a first target luminance which is set based on the first grayscale value;

re-measuring the luminance of the pixels which emit light based on a first compensated grayscale value which is generated by compensating the first grayscale value by the compensation grayscale value; and calculating a luminance difference between the re-measured luminance and the first target luminance.

2. The optical compensation method of claim 1, wherein the first grayscale value is a maximum grayscale value from among grayscale values which are used in the display device, and wherein the first target luminance is determined based on a grayscale-luminance characteristic of the pixel and the first grayscale value.

3. The optical compensation method of claim 2, wherein the second target luminance is lower than the first target luminance by B nits, where B is a positive integer.

4. The optical compensation method of claim 1, wherein the compensation grayscale value is a grayscale value difference between the first grayscale value and a second grayscale value, and wherein the pixel is configured to emit light having a second target luminance based on the second grayscale value.

5. The optical compensation method of claim 4, wherein the calculating the compensation grayscale value of the pixel comprises:

calculating a luminance error between the second target luminance and the measured luminance; and calculating the compensation grayscale value based on the second target luminance, the luminance error, and the first grayscale value.

6. The optical compensation method of claim 5, wherein the compensation grayscale value is proportional to the luminance error.

7. The optical compensation method of claim 1, further comprising:

storing the compensation grayscale value in a memory device in the display device.

8. The optical compensation method of claim 7, further comprising:

performing a second multi-time program (MTP) based on the first grayscale value and the first target luminance, the performing the second multi-time program comprising:

the re-measuring the luminance of the pixels; and the calculating the luminance difference between the re-measured luminance and the first target luminance.

9. The optical compensation method of claim 8, wherein the performing the second multi-time program comprises:

providing the test data to the display device;

and when the luminance difference exceeds a reference value, changing a first gamma voltage corresponding to the first compensated grayscale value.

10. The optical compensation method of claim 9, wherein the performing the second multi-time program further comprises:

repeating each of the step of providing the test data to the display device through the step of changing the first gamma voltage; and when the luminance difference is lower than the reference value, storing the first gamma voltage.

11. An optical compensation method for a display device comprising a pixel, the method comprising:

performing a first multi-time program (MTP) based on a third target luminance and a first grayscale value;

providing test data having the first grayscale value to the display device;

measuring a luminance of the pixel based on the test data; and calculating a compensation grayscale value of the pixel based on a first target luminance and the measured luminance of the pixel, the calculating the compensation grayscale value comprising:

calculating a luminance error between the first target luminance and the measured luminance; and calculating the compensation grayscale value based on the first target luminance, the luminance error, and the first grayscale value, wherein the first target luminance is determined based on the first grayscale value, and wherein the third target luminance is higher than the first target luminance.

12. The optical compensation method of claim 11, wherein the first grayscale value is a maximum grayscale value from among grayscale values which are used in the display device, and wherein the first target luminance is determined based on a grayscale-luminance characteristic of the pixel and the first grayscale value.

13. The optical compensation method of claim 12, wherein the third target luminance is higher than the first target luminance by C nits, where C is a positive integer.

14. The optical compensation method of claim 11, wherein the compensation grayscale value is to compensate the first grayscale value for the pixel to emit light having the first target luminance.

15. The optical compensation method of claim 11, further comprising:

storing the compensation grayscale value in a memory device in the display device.

16. A display device comprising:

a display panel comprising a pixel;

a memory device configured to store a compensation grayscale value to compensate a first grayscale value of input data such that the pixel emits light having a first target luminance based on the first grayscale value;

a timing controller configured to operate in a normal mode and in a compensation mode, the timing controller being further configured to generate a first compensated grayscale value by compensating the first grayscale value based on the compensation grayscale value in the compensation mode; and a data driver configured to generate a data signal based on the first compensated grayscale value, wherein, when the timing controller is in the normal mode, the pixel emits light having a second target luminance based on the first compensated grayscale value, and wherein the second target luminance is lower than the first target luminance.

17. The display device of claim 16, wherein, when the timing controller is in the compensation mode, the pixel emits light having the first target luminance based on the first compensated grayscale value.

18. The display device of claim 16, wherein the timing controller is further configured to determine whether or not the first compensated grayscale value is equal to the first grayscale value.

* * * * *